US006402098B2

(12) United States Patent
Rosky

(10) Patent No.: US 6,402,098 B2
(45) Date of Patent: Jun. 11, 2002

(54) SUPPORT FRAME FOR PLASTIC BAG WITH HANDLES HAVING RESERVOIR BAG ATTACHMENT

(75) Inventor: Gregory C. Rosky, Des Moines, IA (US)

(73) Assignee: Underground Company, L.T.D., Des Moines, IA (US)

( * ) Notice: Subject to any disclaimer, the term of this patent is extended or adjusted under 35 U.S.C. 154(b) by 0 days.

(21) Appl. No.: 09/739,169

(22) Filed: Dec. 18, 2000

Related U.S. Application Data

(63) Continuation-in-part of application No. 09/647,440, filed on Sep. 28, 2000, which is a continuation-in-part of application No. PCT/US99/06757, filed on Mar. 29, 1999.

(60) Provisional application No. 60/079,905, filed on Mar. 30, 1998.

(51) Int. Cl.[7] ..... B65B 67/04

(52) U.S. Cl. ..... 248/99; 53/390; 248/175

(58) Field of Search ..... 248/99, 95, 100, 248/101, 175, 165, 188.91; 53/390

(56) References Cited

U.S. PATENT DOCUMENTS

| | | | | |
|---|---|---|---|---|
| 3,186,667 A | | 6/1965 | Meuer | |
| 3,747,298 A | * | 7/1973 | Lieberman | 248/100 X |
| 4,062,170 A | * | 12/1977 | Orem | 248/100 X |
| 4,921,193 A | | 5/1990 | Benesch | |
| 5,222,704 A | | 6/1993 | Light | |
| 5,263,672 A | | 11/1993 | He | |
| 5,685,432 A | * | 11/1997 | Maldoff | 206/554 |
| 5,799,908 A | * | 9/1998 | Downs | 248/97 |
| 5,921,512 A | * | 7/1999 | Torres | 248/99 |

* cited by examiner

*Primary Examiner*—Ramon O. Ramirez

(57) ABSTRACT

A support frame for a plastic bag with opposite handles has a horizontal rectangular base member in the form of a tray with four upstanding struts extending from sockets in the corners of the tray. Horizontal braces are frictionally secured between two each of the struts. The upper end of the struts terminate in U-shaped hooks that extend inwardly in a direction towards the space over the base member to permit a bag with separate upper handles and a body portion to have one each of its handles supported on opposite pairs of the hooks with the body portion suspended therebetween. A fresh bag reservoir is detachably secured to one of the pair of end most struts, and has an open top, and which does not enlarge the profile of the unit.

1 Claim, 9 Drawing Sheets

SUPPORT FRAME FOR PLASTIC BAG WITH HANDLES HAVING RESERVOIR BAG ATTACHMENT

RELATED APPLICATIONS

This is a continuation-in-part application of U.S. Ser. No. 09/647,440 filed Sep. 28, 2000 which is a continuation-in-part of PCT Application PCT/US99/06757 filed Mar. 29, 1999 which is a conversion of Provisional Patent Application Ser. No. 60/079,905 filed Mar. 30, 1998.

BACKGROUND OF THE INVENTION

Plastic bags with handles are fast replacing conventional paper bags for carrying groceries and other goods from supermarkets and other retail stores. The plastic bags have further use in homes after their primary use is finished in that the bags have further utility as containers for trash. Frames such as that shown in U.S. application Ser. No. 09/647,440 are useful for supporting the bags as trash receptacles. However, it is sometimes a nuisance not to have a supply of fresh bags readily available for trash usage on the frames. It is therefore a principal object of this invention to provide a support frame for such trash bags which will include a reservoir for fresh bags.

A further object of the invention is to provide a support frame for such bags where the trash bag reservoir is easy to use and easy to attach to the frame, and is space efficient, and is inexpensive to construct, and refined in appearance.

These and other objects will be apparent to those skilled in the art.

SUMMARY OF THE INVENTION

A support frame for a plastic bag with opposite handles has a horizontal rectangular base member in the form of a tray with four upstanding struts extending from sockets in the corners of the tray. Horizontal braces are frictionally secured between two each of the struts. The upper end of the struts terminate in U-shaped hooks that extend inwardly in a direction towards the space over the base member to permit a bag with separate upper handles and a body portion to have one each of its handles supported on opposite pairs of the hooks with the body portion suspended therebetween. A fresh bag reservoir is detachably secured to one of the pair of end-most struts, and has an open top, and which does not enlarge the profile of the unit.

DESCRIPTION OF THE PREFERRED EMBODIMENT

Figure 1:
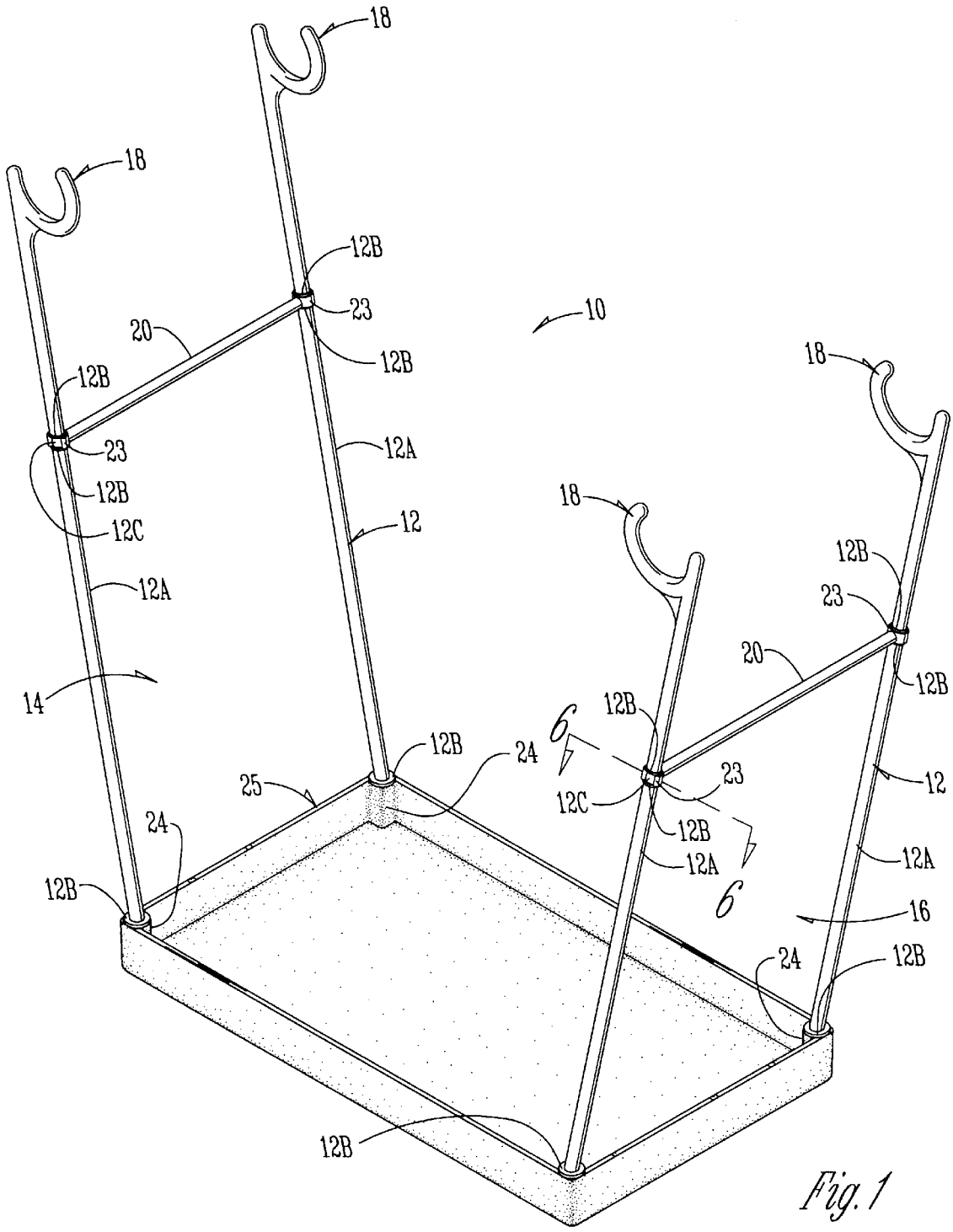
FIG. 1 is a perspective view of the support frame.

The support frame 10 (FIG. 1) has duplicate spaced opposite sides 12 which have upwardly and outwardly extending end portions 14 and 16 terminating in hooks 18. The U-shaped hooks are open at the top and extend inwardly in a direction towards the space between the end portions to permit a bag with separate upper handles and a body portion to have one each of its handles supported on opposite pairs of the hooks with the body portion suspended therebetween.

Figure 6:
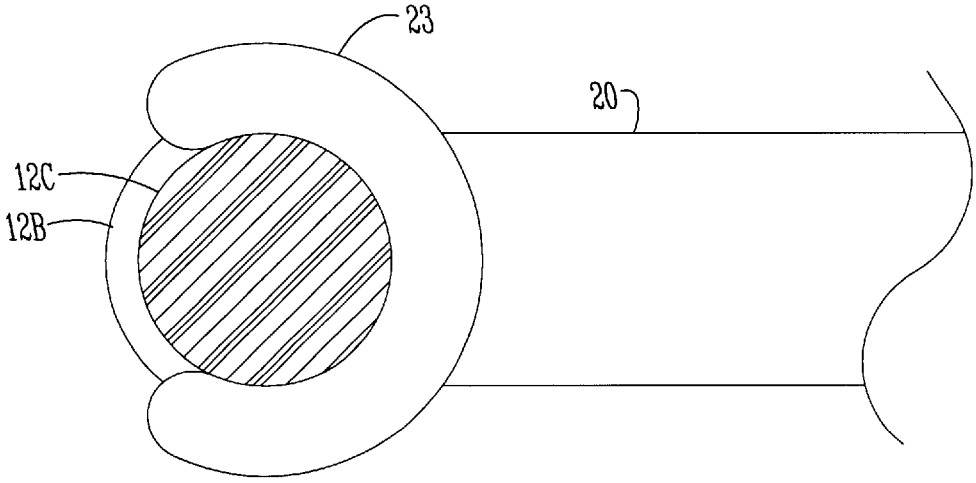
FIG. 6 is an enlarged scale sectional view taken on line 6—6 of FIG. 1.
Figure 7:
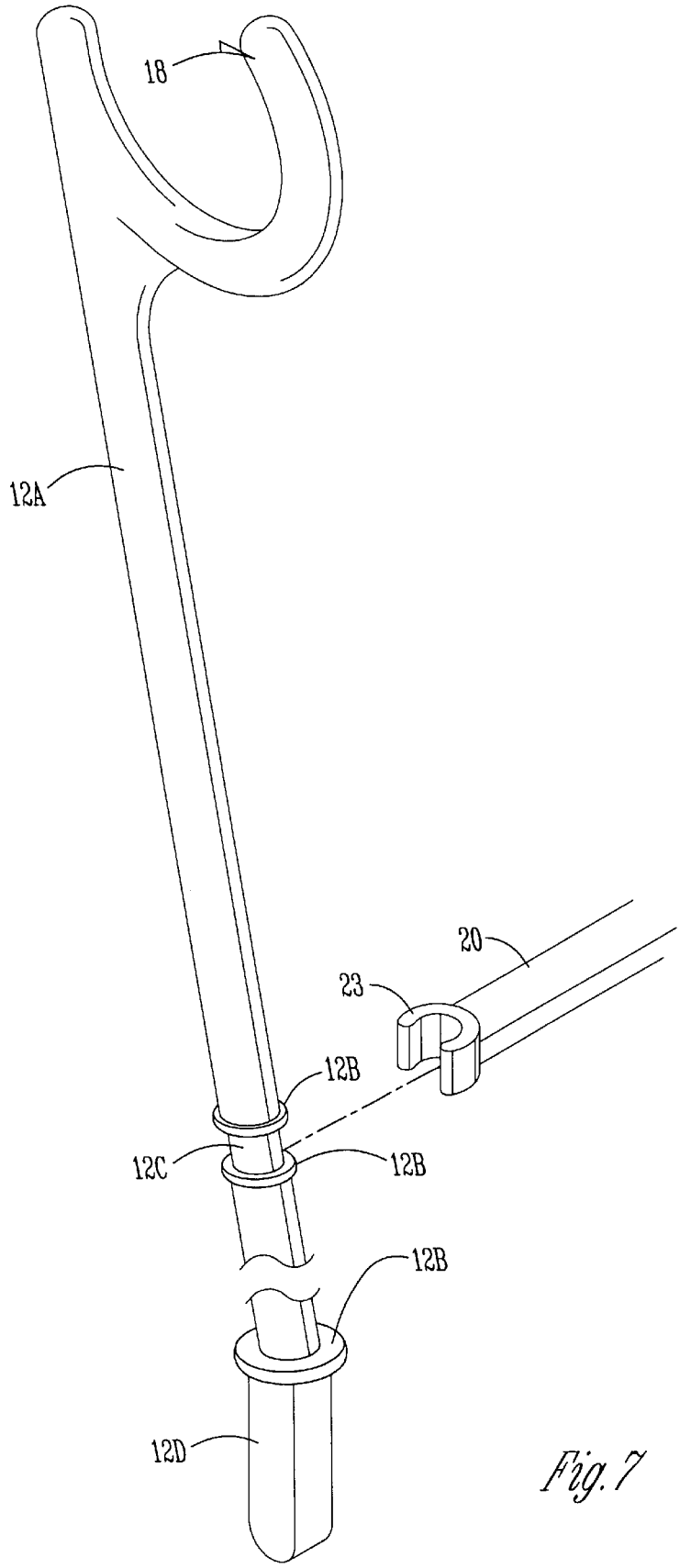
FIG. 7 is an exploded partial perspective view of a strut that receives a cross brace.
Figure 8:
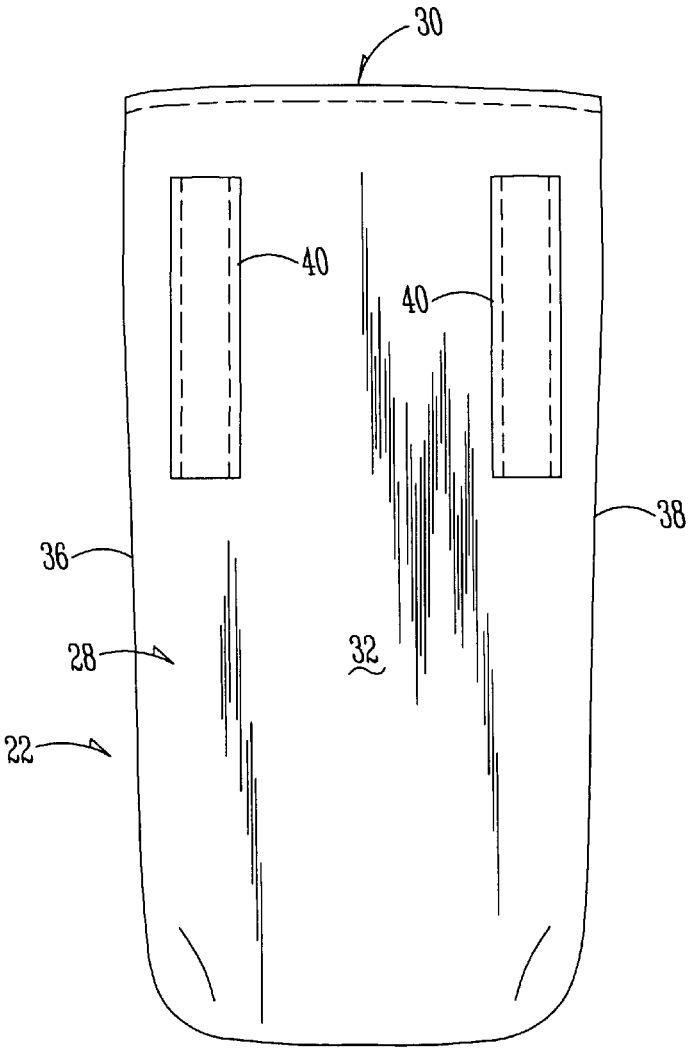
FIG. 8 is an inner side elevational view of the fresh bag reservoir.

Braces 20 secure sides 12 together. A fresh bag reservoir 22 is mounted on one end pair of struts 12A and braces 20. Frame 10 is comprised of stiff but resilient plastic material (struts 12A and braces 20). The ends of the braces 20 have U-shaped snap connectors 23 to detachably but frictionally engage struts 12 A (FIG. 6). The snap connections 23 are nested between annular rings 12B in area 12C (FIG. 7).

The lower square ends 12D of struts 12A are detachably frictionally inserted into the sockets 24 of the four sided tray 25. An annular ring 12A is also located above the end 12D.

It should also be noted that the square lower ends 12D of the struts 12A are normally received in a vertical configuration within the sockets 24. The strut however is then bent slightly outwardly from the square ends 12D as clearly shown in FIGS. 1 and 7.

Figure 5:
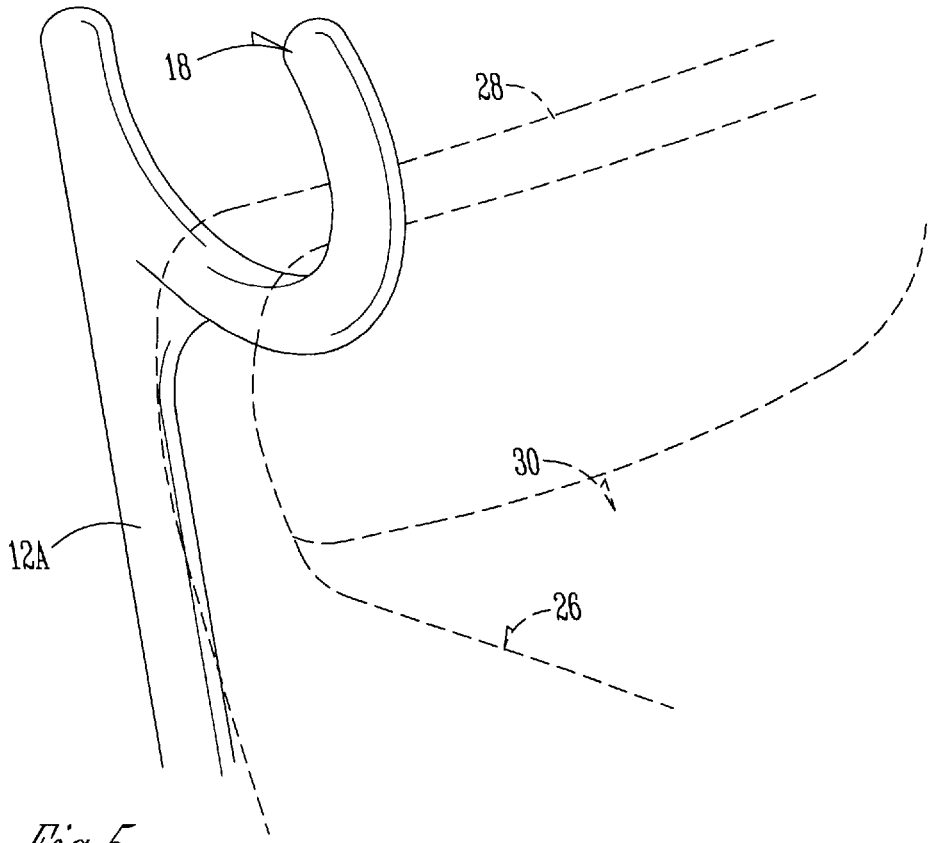
FIG. 5 is an enlarged scale perspective view of a hook on the frame for supporting the bag.

A bag 26 has opposite loop handles 28. The handles are draped over the hooks 18 as shown by the dotted lines in FIGS. 2 and 5. The top opening 30 of the bag is thereby held in an open condition (FIG. 3).

It should be noted that the length of the struts 12A is such that when the bag 26 is suspended on hooks 18, the bottom of the bags 26 can rest on the bottom of the tray 25.

For shipping and packaging purposes, the struts 12A are removed from the sockets 24, and the braces 20 and 22 are detachably removed from the struts by means of the U-shaped snap connectors 23. The support frame 10 is thereupon easily assembled by inserting the struts 12A into the sockets 24, and then placing the braces 20 and 22 in connection with the struts 12A as described above through the use of the U-shaped snap connectors 23. The frame in operation is therefore very sturdy, but the frame 10 does has some slight resiliency to slightly flex depending upon the degree to which the bag 26 is filled with trash or the like. When the bag is full, it is easily removed from the hooks 18, and replaced with another disposable bag.

Figure 9:
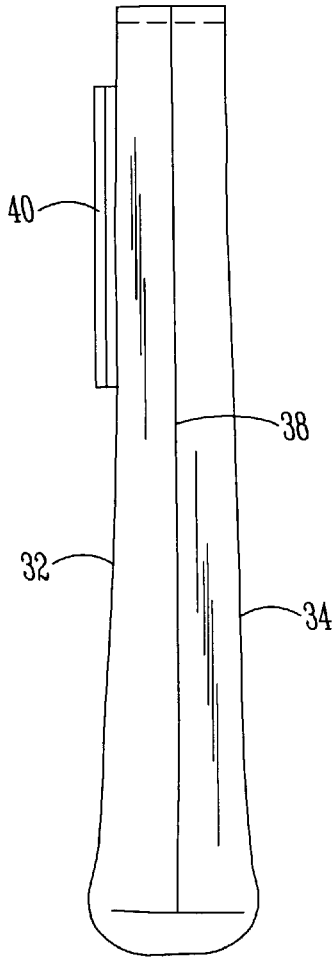
FIG. 9 is an edge elevational view of the fresh bag reservoir.
Figure 10:
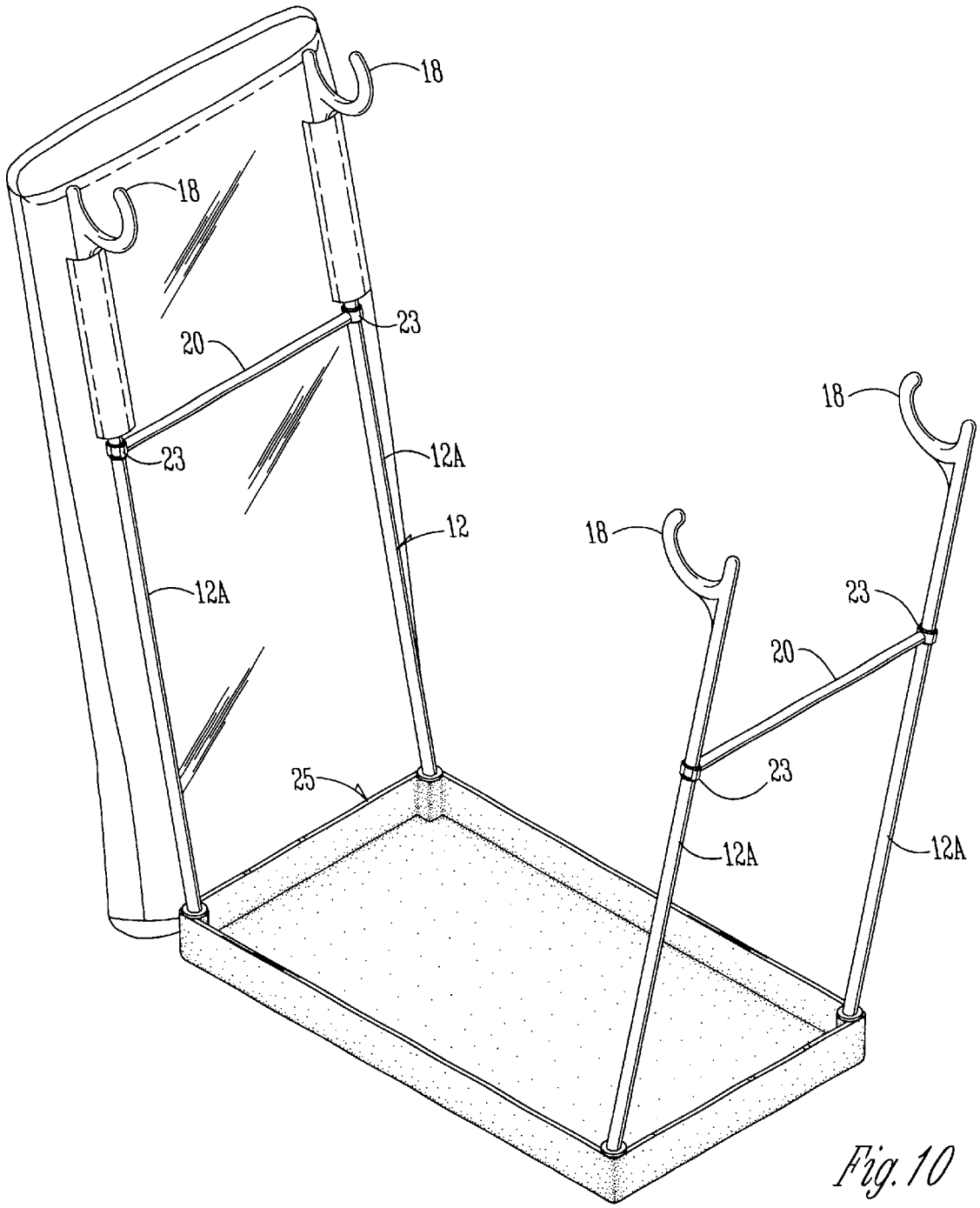
FIG. 10 is a perspective view of the device of the invention with the fresh bag reservoir attached.
Figure 11:
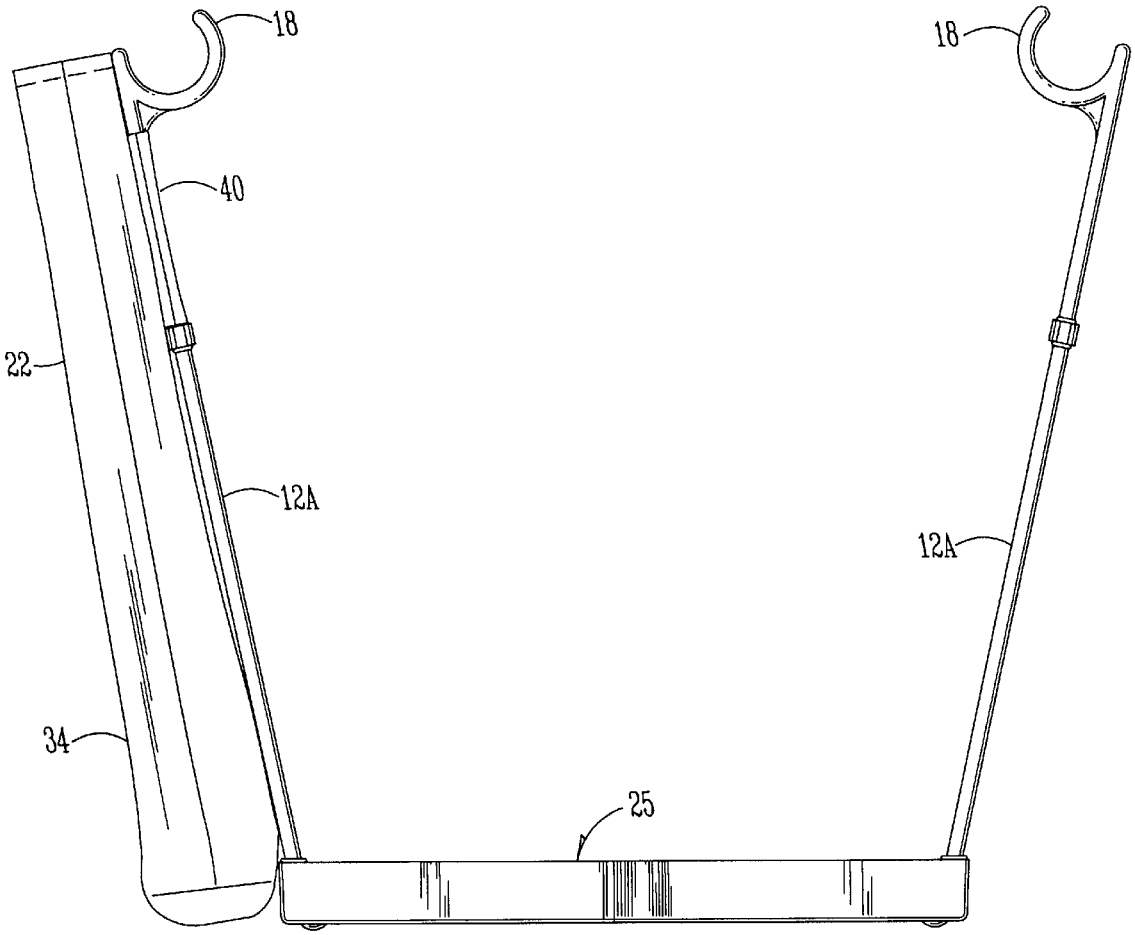
FIG. 11 is a side elevational view of FIG. 10.

The reservoir bag 22 has a body 28 with an open top 30, and a height substantially equal to that of frame 10. It has an inner side 32 and an outer side 34, and side edges 36 and 38. Two elongated strips 40 are stitched to the upper side edges 30 on the inner side 32 to slidably receive the struts 12A when the frame 10 is disassembled. The lower ends of disassembled struts 12A are inserted downwardly through the hollow interiors of straps 40 so that the open top 30 is located just below the hooks 18 (FIG. 10). The brace 20 is then snapped onto the strips 12A so that the bag 22 assumes the position shown in FIG. 11. It should be noted that the bottom of the bag 22 normally dwells inside a vertical plane passing downwardly through the upper end of struts 12A so as not to increase the over length of the unit. (FIG. 9). The lower ends of the struts 12A are then assembled into the corners of tray 25 as described above. The strips 40 encompass the portion of struts 12A from braces 20 upwardly to the bottom of hooks 18.

Figure 2:
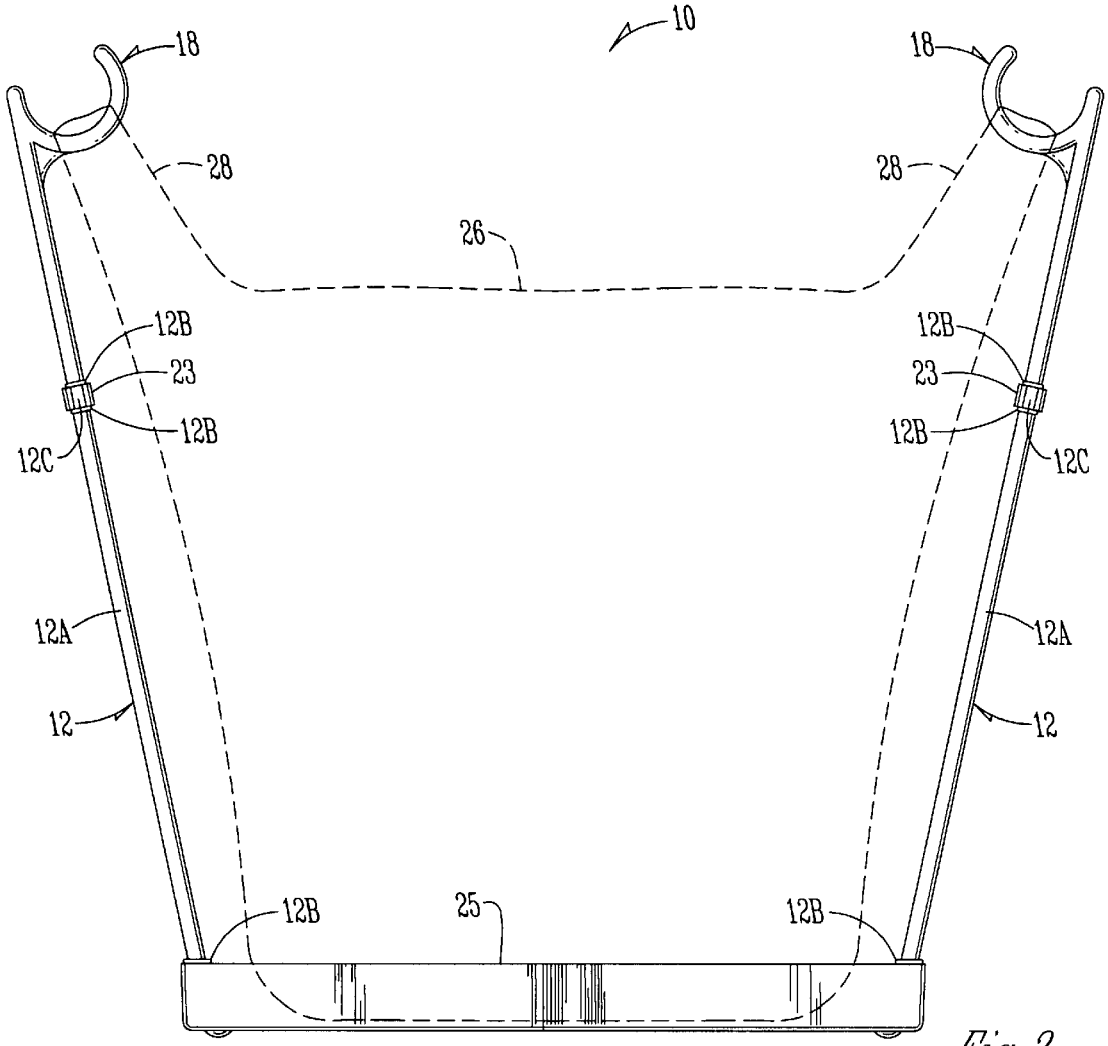
FIG. 2 is a side elevational view of the support frame with a plastic bag shown in dotted lines supported by the frame.
Figure 3:
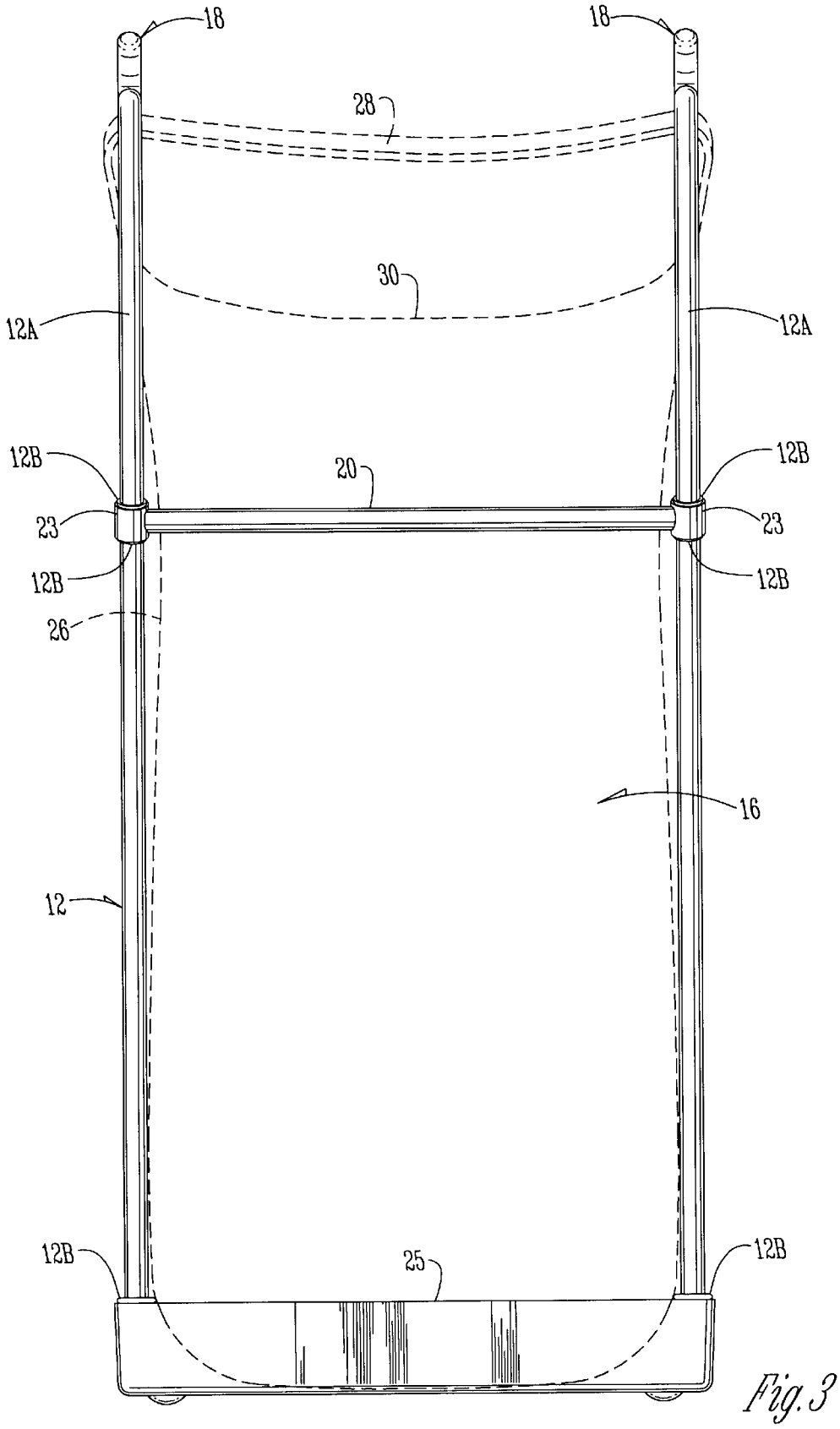
FIG. 3 is an end elevational view thereof.
Figure 4:
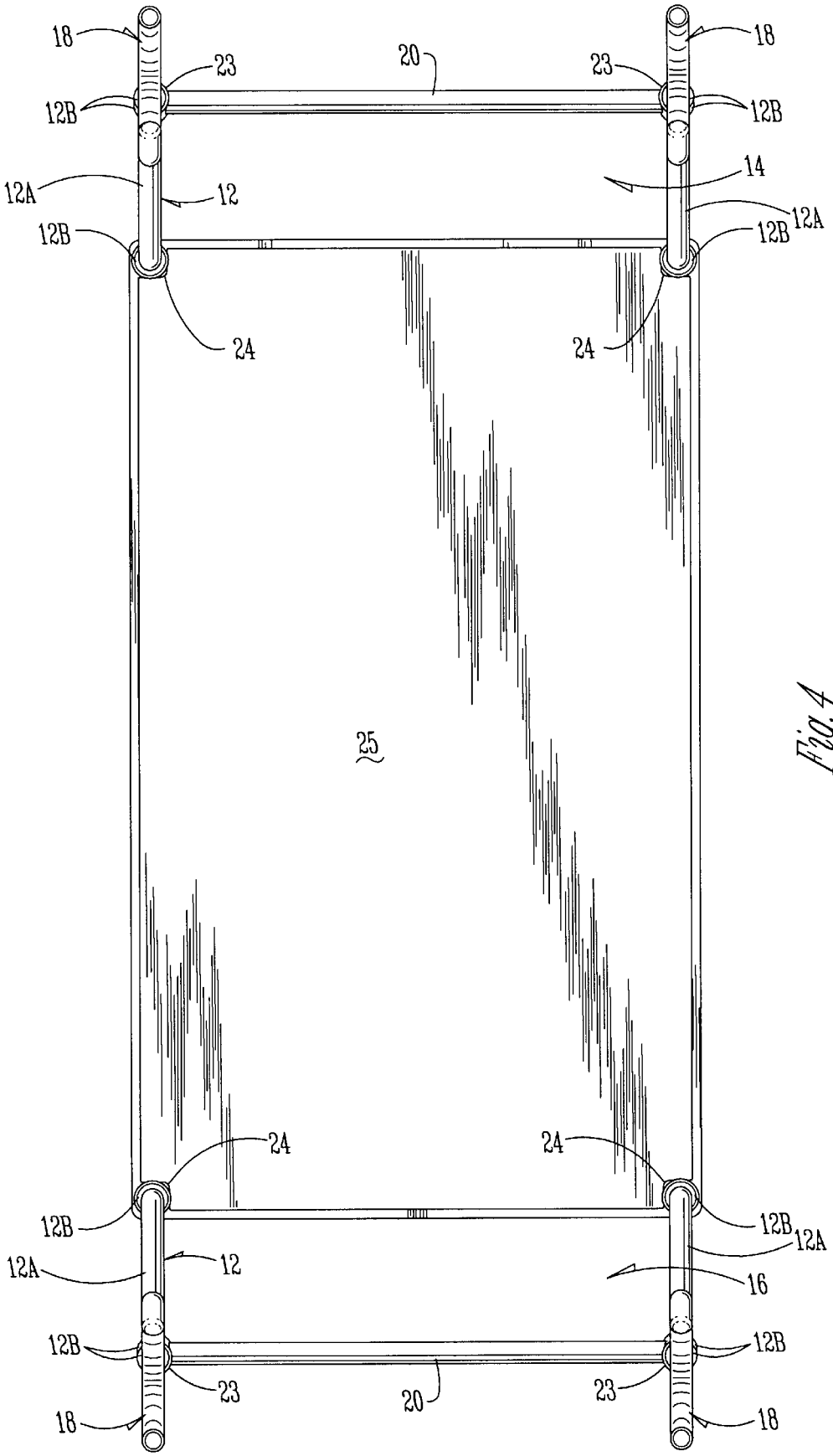
FIG. 4 is a top plan view thereof.

Fresh replacement bags 26 can be easily inserted into the bag 22 for use and quick accessibility after the mounted bag 26 of FIGS. 2 and 3 are filled and removed.

Thus, it is seen that the device of this invention is easily assembled; requires little space, and enhances the utility of the basic frame 10.

It is therefore seen that this invention will achieve at least all of its stated objectives.

What is claimed is:

1. A support frame for a plastic bag, comprising:

a horizontal rectangular base member with four upstanding struts, means for suspending a bag in an open position between the struts, the struts being detachably secured to the base member, the bag having an open top and hollow retention strips for receiving the upper ends of the struts upon which the bag is mounted, a cross brace that extends between the struts and supports the bag, the cross brace being located below the lower ends of the strips and detachably secured to the struts that support the bag, and a fresh replacement bag reservoir attached to at least two of the struts to house replacement bags for subsequent mounting on the structure.

* * * * *